US009196985B2

(12) United States Patent
Miller et al.

(10) Patent No.: US 9,196,985 B2
(45) Date of Patent: Nov. 24, 2015

(54) CONFIGURABLE ELECTRICAL CONNECTOR ASSEMBLY

(71) Applicant: Tyco Electronics Corporation, Berwyn, PA (US)

(72) Inventors: Keith Miller, Manheim, PA (US); Hung Thai Nguyen, Harrisburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 52 days.

(21) Appl. No.: 14/151,470

(22) Filed: Jan. 9, 2014

(65) Prior Publication Data

US 2015/0194754 A1 Jul. 9, 2015

(51) Int. Cl.

| | |
|---|---|
| ***H01R 12/72*** | (2011.01) |
| ***H01R 12/71*** | (2011.01) |
| ***H01R 13/6585*** | (2011.01) |
| *H01R 13/66* | (2006.01) |
| *H01R 9/24* | (2006.01) |

(52) U.S. Cl.

CPC ..... *H01R 12/721* (2013.01); *H01R 12/712* (2013.01); *H01R 13/6585* (2013.01); *H01R 9/2458* (2013.01); *H01R 13/6658* (2013.01)

(58) Field of Classification Search

CPC .. H01R 13/66; H01R 13/6608; H01R 13/665; H01R 13/6658

See application file for complete search history.

(56) References Cited

U.S. PATENT DOCUMENTS

| | | | | |
|---|---|---|---|---|
| 4,972,470 | A | 11/1990 | Farago | |
| 5,587,884 | A * | 12/1996 | Raman | 361/728 |
| 5,647,767 | A * | 7/1997 | Scheer et al. | 439/620.17 |
| 5,924,899 | A * | 7/1999 | Paagman | 439/701 |
| 6,824,391 | B2 | 11/2004 | Mickievicz | |
| 6,848,951 | B1 | 2/2005 | Bechaz et al. | |
| 6,932,649 | B1 * | 8/2005 | Rothermel et al. | 439/620.01 |
| 7,168,988 | B1 | 1/2007 | Rothermel | |
| 7,175,445 | B2 | 2/2007 | Consoli | |
| 8,251,721 | B2 * | 8/2012 | Ikeda et al. | 439/188 |
| 8,686,600 | B2 * | 4/2014 | Terlizzi et al. | 307/125 |
| 8,961,194 | B2 * | 2/2015 | Ye | 439/69 |
| 8,992,260 | B2 * | 3/2015 | Coffey et al. | 439/620.22 |
| 8,992,261 | B2 * | 3/2015 | Mattson | 439/620.23 |
| 2006/0046568 | A1 | 3/2006 | Consoli et al. | |
| 2007/0134986 | A1 * | 6/2007 | Hemmah | 439/620.21 |
| 2007/0220499 | A1 * | 9/2007 | Bannatyne et al. | 717/140 |
| 2013/0203273 | A1 | 8/2013 | Rathburn | |

OTHER PUBLICATIONS

European Search Report, Mail Date, Jun. 10, 2015, EP 15 15 0636, Application No. 15150636.7-1801.

* cited by examiner

*Primary Examiner* — Ross Gushi

(57) ABSTRACT

A configurable connector system may include a connector assembly including a housing, and at least one wafer retained within the housing. The wafer(s) may include at least one active device in communication with at least one programmable memory component. The active device(s) may be configured to operate based on programming instructions or settings stored within the programmable memory component. The housing of the connector assembly may include an open programmer-receiving channel configured to receive at least a portion of an external programmer that is configured to send the programming instructions or settings to the at least one programmable memory component.

20 Claims, 6 Drawing Sheets

CONFIGURABLE ELECTRICAL CONNECTOR ASSEMBLY

BACKGROUND OF THE DISCLOSURE

Embodiments of the present disclosure generally relate to electrical connector assemblies, and, more particularly, to electrical connector assemblies having configurable wafers.

Right angle connectors have been used to connect printed circuit boards. The right angled connectors may include a plurality of receiving terminals oriented at a right angle to a number of a plurality of pins. One common implementation of such connectors is to join daughter cards with a backplane in a data transmission system. In conventional systems, connectors have been proposed that are able to support bi-directional data streams arranged point-to-multipoint for channel access configuration. The conventional bi-directional data streams may convey signals in opposite directions over each individual trace through the connector.

Existing channel access bus architectures typically utilize a single driver or transmitter, such as arranged on one daughter card that transmits a signal along a trace along the backplane. The trace on the backplane may be tapped at multiple locations to feed a plurality of receivers on an equal plurality of daughter cards. Hence, a single transceiver (transmitter/receiver) on a first daughter card may communicate along a common trace over the backplane to a plurality of transceivers arranged on separate other daughter cards.

However, conventional configurations have experienced insufficient signal integrity at high data rates. As the data rate increases, the high frequency components of the signal experience more loss due to more reflection and dielectric loss within the backplane and connector assemblies interconnecting the daughter cards. Signal degradation may increase as the number of daughter cards increases. The energy conveyed along the backplane divides at each point where a daughter card connector taps into a trace on the backplane.

In order to condition or otherwise boost signals conveyed through traces, one or more active devices may be used. Typically, an active device may be disposed directly on a daughter card or backplane. Depending on the application, the active device needs to be configured to effectively equalize the signals conveyed through the traces. In general, the available space on the daughter card and backplane is limited, however.

BRIEF DESCRIPTION OF THE DISCLOSURE

Certain embodiments of the present disclosure provide a configurable connector system that may include a connector assembly including a housing, and at least one wafer retained within the housing. The wafer(s) may include at least one active device, such as an equalizer, in communication with at least one programmable memory component, such as an electrically erasable programmable read only memory (EEPROM). The active device(s) may be configured to operate based on programming instructions or settings stored within the at least one programmable memory component.

The housing of the connector assembly may include an open programmer-receiving channel configured to receive at least a portion of an external programmer that is configured to send the programming instructions or settings to the at least one programmable memory component. In at least one embodiment, the system may include an external programmer having a mating interface configured to removably mate with a portion of the wafer(s). The external programmer is configured to send the programming instructions or settings to the at least one programmable memory component. The mating interface may include a main body having one or more wafer-engaging slots configured to mate with the portion of the at least one wafer.

The wafer may include one or more programming contact pads connected to the at least one programmable memory component through at least one first trace. The programmable memory component receives the programming instructions from the programming contact pad(s) through the at least one trace. The wafer(s) may also include at least one second trace that connects the active device with the programmable memory component. The programmable memory component communicates with the at least one active device through the second trace(s). The wafer(s) may also include at least one power contact pad connected to one or both of the active device and the programmable memory component through at least one power trace.

Certain embodiments of the present disclosure provide a wafer configured to be retained within a housing of a connector assembly. The wafer may include at least one active device configured to condition signals conveyed between at least one first signal contact pad and at least one second signal contact pad. The wafer may also include at least one programmable memory component in communication with the at least one active device. The active device(s) may be configured to operate based on programming instructions or settings stored within the programmable memory component.

Certain embodiments of the present disclosure provide a method of configuring a connector assembly including a housing that retains at least one wafer having at least one active device and at least one programmable memory component mounted on the at least one wafer. The method may include aligning an external programmer with an opening formed in the housing, wherein the opening exposes one or more programming contact pads of the at least one wafer. The method may also include moving a wafer interface of the external programmer into the opening so that contacts of the external programmer connect to the one or more programming contact pads of the at least one wafer. The method may also include transmitting programming instructions or settings from the external programmer to the at least one programmable memory component of the at least one wafer, storing the programming instructions or settings within the at least one wafer, and operating the at least one active device of the at least one wafer based on the programming instructions or settings stored in the at least one programmable memory component. The method may also include removing the external programmer from the opening formed in the housing after the operation.

DETAILED DESCRIPTION OF THE DISCLOSURE

Figure 1:
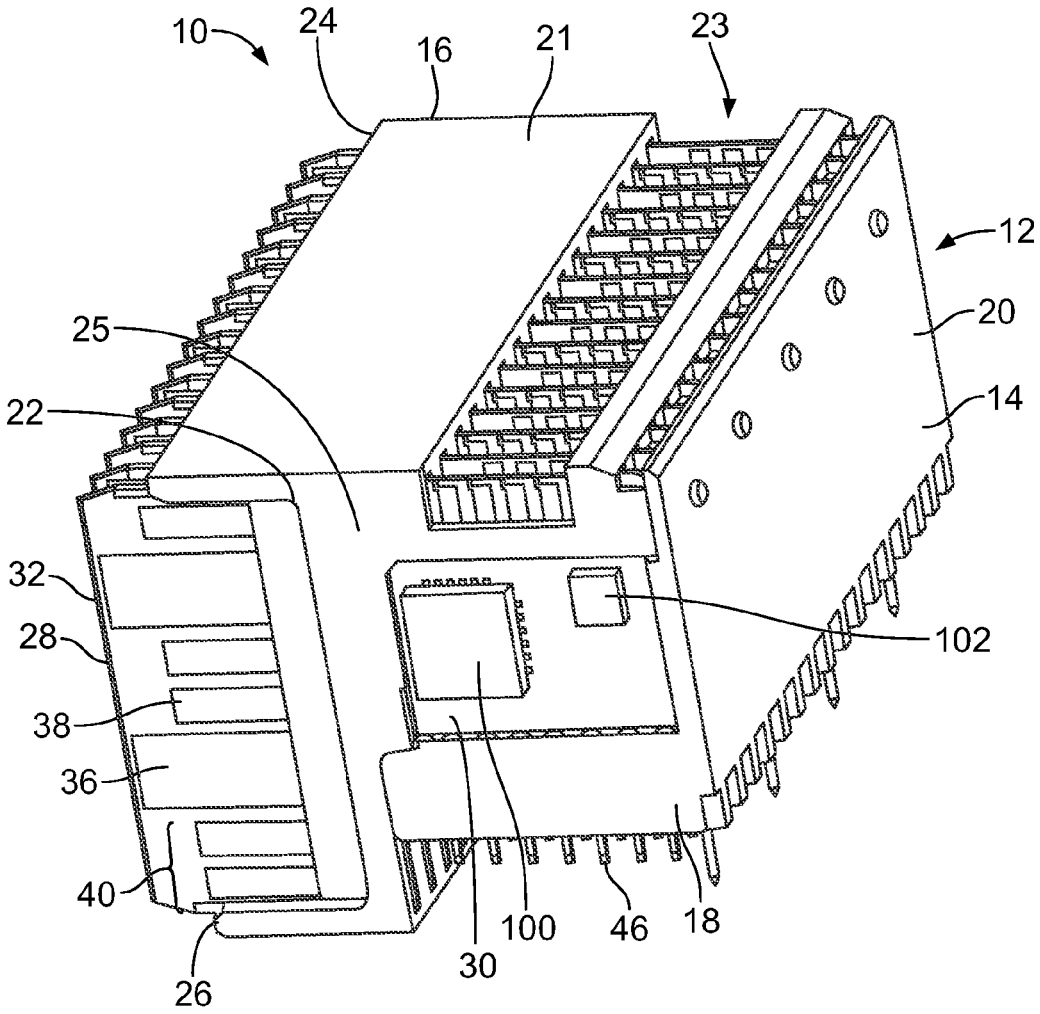
FIG. 1 illustrates a perspective view of a connector assembly 10, according to an embodiment of the present disclosure.

FIG. 1 illustrates a perspective view of a connector assembly 10, according to an embodiment of the present disclosure. The connector assembly 10 may include a housing 12 that may include an L-shaped frame 14 that securely mates with a cover 16. The frame 14 includes a lower face that defines a daughter card interface 18 formed integrally with a backwall 20. The cover 16 includes a top wall 21 formed integrally with a front wall defining a backplane connector assembly interface 22. As shown in FIG. 1, an open programmer-receiving channel 23 may be formed through the top wall 21 spanning between lateral walls 25 of the cover 16. The programmer-receiving channel 23 exposes top edges of wafers 30.

The backplane connector assembly interface 22 may include upper and lower flanges 24 and 26 extending outward from the backplane connector assembly interface 22 to define a contact mating area 28. The frame 14 and cover 16 receive and retain a plurality of daughter cards or wafers 30 that may be arranged parallel to, and spaced apart from, one another. Optionally, the wafers 30 may be separated by ground shields (not shown).

Each wafer 30 may include an edge defining a backplane edge 32 that extends through slots formed in the backplane connector assembly interface 22. The backplane edge 32 of each wafer 30 may include a series of ground and signal contact pads 36 and 38, respectively, arranged in a predefined sequence.

The signal contact pads 38 may be disposed along one side of each wafer 30. The signal contact pads 38 may be further arranged in differential pairs (one example of which is denoted by bracket 40), in which each differential pair 40 of signal contact pads 38 may be separated by a ground contact pad 36. The ground contact pads 36 may be longer than the signal contact pads 38 to extend outward to the backplane edge 32. The signal contact pads 38 may be positioned on the wafer 30 spaced slightly inward from the backplane edge 32.

With reference to the daughter card interface 18, a series of positioning pins (not shown) may be provided and are configured to be received in holes in a wafer 30 to facilitate alignment therebetween. The daughter card interface 18 may include a plurality of holes (not shown) through which contacts 46 project. The upper ends (not shown) of the contacts 46 mate with contact pads on the wafer 30. The ends of the contacts 46 extending downward from the daughter card interface 18 are configured to be received in vias or through holes provided in a daughter card, printed circuit board, or the like that mates with the connector assembly 10.

As shown, one or more wafers 30 may include an active device 100 and a programmable memory component 102 mounted thereon. For example, each wafer 30 within the connector assembly 10 may include an active device 100, such as an equalizer, and a programmable memory component 102. The active device 100 electrically connects to the programmable memory component 102, such as through one or more traces. As such, the active device 100 may communicate with the programmable memory component 102. The programmable memory component 102 may communicate with the active device 100 in order to adaptively program, operate, and/or configure the active device 100 based on programming instructions or settings stored in the programmable memory.

The programmable memory component 102 may be of various types. For example, the programmable memory component 102 may be or include an electrically erasable programmable read only memory (EEPROM). Alternatively, the programmable memory component 102 may be or include a programmable read only memory (PROM), a fixed programmable read only memory (FPROM), a one-time programmable non-volatile memory (OTP NVM), an erasable programmable read only memory (EPROM), and/or the like.

Figure 2:
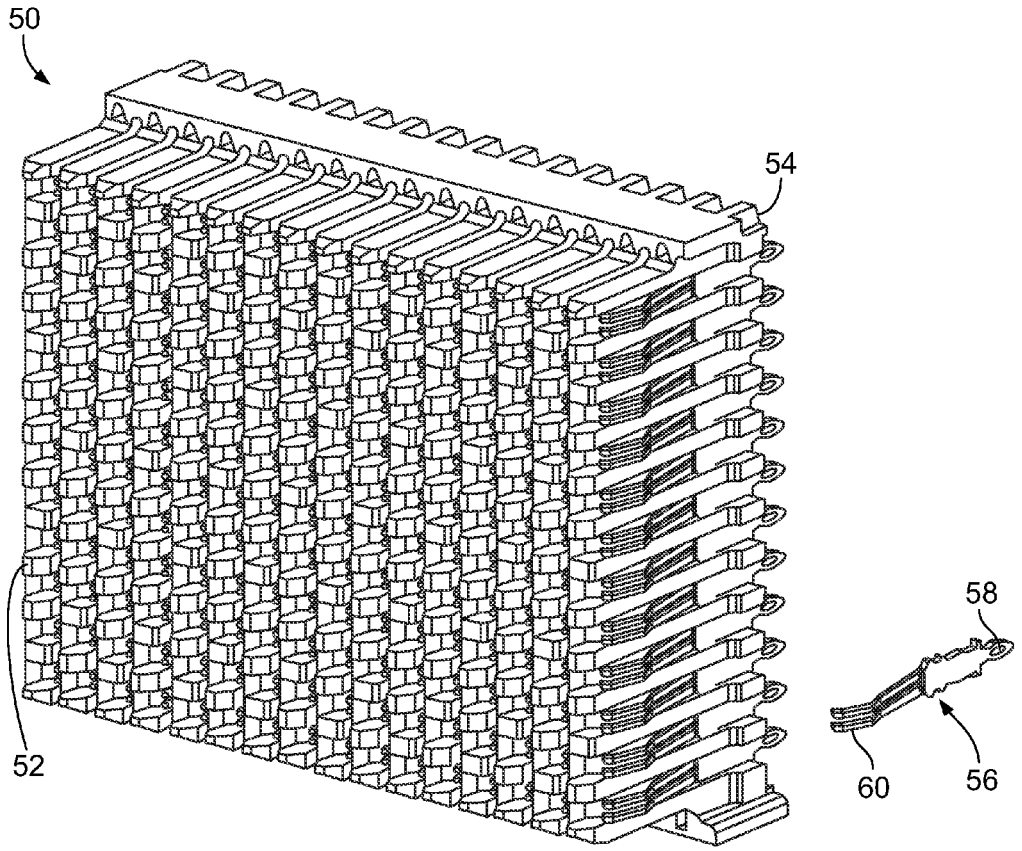
FIG. 2 illustrates a perspective view of a backplane connector assembly configured to be joined with a daughter card connector assembly, according to an embodiment of the present disclosure.

FIG. 2 illustrates a perspective view of a backplane connector assembly 50 configured to be joined with the connector assembly 10 (shown in FIG. 1), according to an embodiment of the present disclosure. Referring to FIGS. 1 and 2, the backplane connector assembly 50 includes a front face 52 that fits in and mates with the contact mating area 28 of the backplane connector assembly interface 22 of the connector assembly 10. The backplane connector assembly 50 includes a back face 54 that is configured to be secured to a backplane printed circuit board (not shown). The backplane connector assembly 50 retains a plurality of contacts 56. Each contact 56 may include an eye of the needle contact tip 58 at one end and a dual beam tip 60 at the opposite end. When the backplane connector assembly 50 is mated with the connector assembly 10, the dual beam tips 60 press against corresponding ground and signal contact pads 36 and 38 on respective wafers 30.

Figure 3:
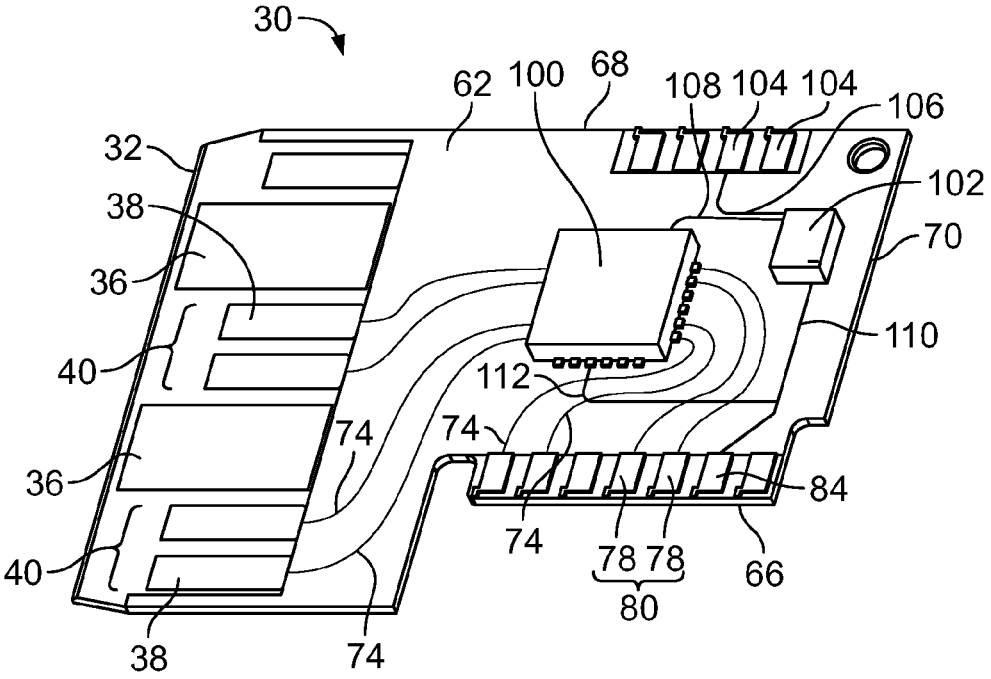
FIG. 3 illustrates a perspective view of a wafer used in a daughter card connector assembly, according to an embodiment of the present disclosure.
Figure 4:
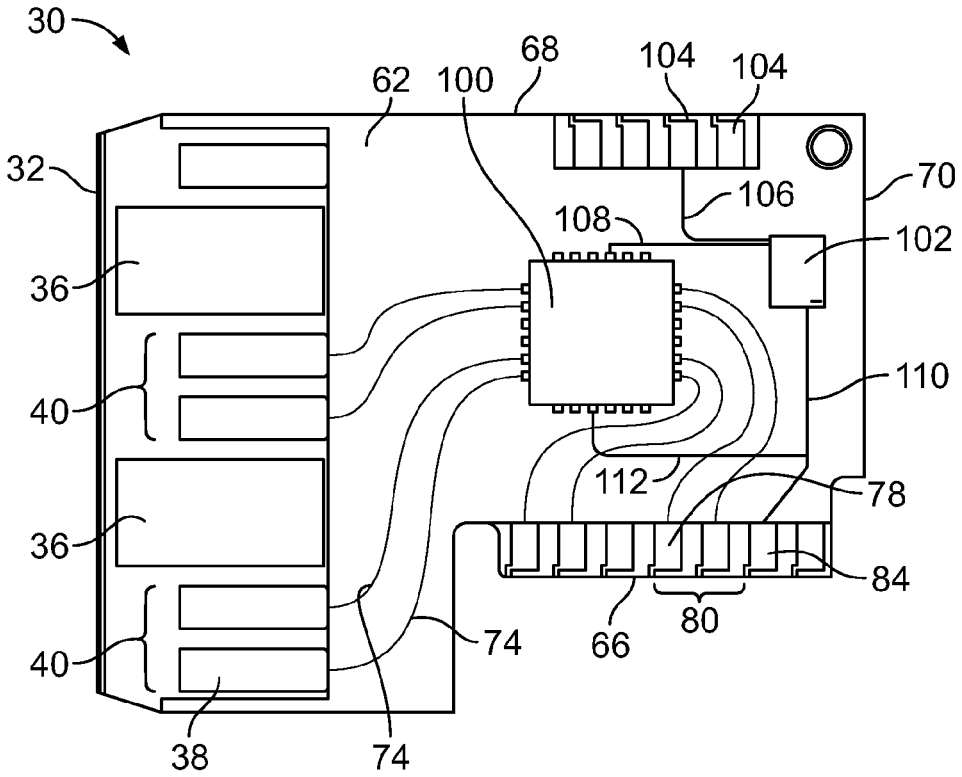
FIG. 4 illustrates a lateral view of a wafer, according to an embodiment of the present disclosure.

FIG. 3 illustrates a perspective view of the wafer 30, according to an embodiment of the present disclosure. FIG. 4 illustrates a lateral view of the wafer 30. For purposes of explanation only, the side illustrated in FIGS. 3 and 4 will be referred to as the front side 62, while the opposite side (not shown) will be referred to as the back side. Referring to FIGS. 3 and 4, the wafer 30 includes the backplane interface edge 32 oriented at a right angle to a daughter card interface edge 66. Optionally, the backplane and daughter card interface edges 32 and 66 may be oriented at acute or obtuse angles with respect to one another (or opposing one another at a 180° angle). The wafer 30 also includes top and back edges 68 and 70, respectively. The front side 62 of the wafer 30 may be formed with multiple ground plane sections that are spaced apart to separate signal traces 74 that may be arranged in differential pairs. The signal traces end at signal contact pads 38 proximate to the backplane edge 32. The traces 74 also end at signal contact pads 78 proximate to the daughter card interface edge 66.

The wafer 30 may be configured to support a serial or uni-directional data stream within a point-to-multipoint channel architecture, in which data signals are conveyed in a single direction through each signal trace 74. Hence, each individual signal contact pad 38 may either receive or transmit signals within the entire point-to-point architecture, while the signal contact pads 78 operate in the exact opposite manner. Accordingly, individual signal contact pads 38 may be configured as dedicated transmit or dedicated receive contact pads. By way of example only, a signal contact pad 38 may represent a dedicated receive or input contact pad that receives serial signals, in which case the interconnected signal contact pad 78 operates as a dedicated transmit or output contact pad to transmit the serial signal.

The signal contact pads 78 may be grouped into differential pairs 80, which may be separated by ground contact pads. Additionally, a power contact pad 84 may be provided proximate to the daughter card interface edge 66. The power contact pad 84 may be joined at a via or through-hole to a trace on the back side of the wafer 30.

It is to be understood that while a first differential pair 80 of signal traces 74 support serial signal transmission in a first direction, a separate and distinct differential pair 80 of signal traces 74 on the same wafer 30 may support a different serial signal transmitting in the opposite direction. Hence, a first set of differential pairs 80 along the daughter card interface edge 66 may represent output contact pads, while a different differential pair 80 of signal contact pads 78, also along the daughter card interface edge 66, may constitute input contact pads.

As noted above, the active device 100 is mounted directly on the wafer 30. The active device 100 connects to the traces 74 between the signal contact pads 38 and the signal contact pads 78 in order to boost, clean, or otherwise condition signals conveyed through the traces 74. The active device 100 is configured to be programmed through the programmable memory component 102, such as an EEPROM. In general, the active device 100 may perform signal compensation. The terms "signal compensation" and "compensation" are used broadly to refer to compensation for signal degradation in a system or point-to-point architecture. Signal degradation may include one or more of transmission medium losses, structural resonances, noise, radiation, jitter and the like.

As shown in FIGS. 3 and 4, a plurality of programming contact pads 104 are disposed on the wafer 30 proximate to the top edge 68. While four programming contact pads 104 are shown, more or less programming contact pads 104 may be used. At least one of the programming contact pads 104 connects to at least one memory-connecting trace 106 that connects to the programmable memory component 102. While only one memory-connecting trace 106 is shown in FIGS. 3 and 4, additional memory-connecting traces may connect the programmable memory component 102 to one or more of the programming contact pads 104.

The programmable memory component 102 is, in turn, connected to the active device 100 through at least one active device-bridging trace 108. While only one active device-bridging trace 108 is shown in FIGS. 3 and 4, additional active device-bridging traces 108 may connect one or more outputs of the programmable memory component 102 with one or more inputs of the active device 100.

The programmable memory component 102 may connect to the power contact pad 84 through a power trace 110. A power branch trace 112 may branch off from the power trace 110 and connect to the active device 100. As such, power may be supplied from the power contact pad 84 to the programmable memory component 102 through the power trace 110, while power may be supplied to the active device 100 through the power trace 110 and the power branch trace 112. Alternatively, instead of a power branch trace, a separate and distinct power trace may connect the power contact pad 84 to the active device 100.

In operation, the active device 100 may be operated according to instructions or settings stored in the programmable memory component 102. The programmable memory component 102 receives programming instructions through the memory-connecting trace(s) 106 that connect to the programming contact pad(s) 104. A separate and distinct external programmer (not shown in FIGS. 3 and 4) may engage the programming contact pad(s) 104 and send programming signals to the programmable memory component 102 via the memory-connecting trace(s) 106. The programming instructions are then stored in the programmable memory component 102. The active device 100 may then be operated based on the instructions or settings stored in the programmable memory component 102. For example, the programmable memory component 102 may be in communication with the active device 100 via the active device-bridging trace(s) 108. Once the programmable memory component 102 receives and stores programming instructions or settings, the external programmer may be removed from the programming contact pad(s) 104, and the active device 100 may be operated according to the programming instructions or settings stored in the programmable memory component 102. Optionally, the programmable memory component 102 may relay the stored instructions or settings to the active device 100, which may, in turn, locally store the instructions or settings.

Accordingly, the connector assembly 10 (shown in FIG. 1) that houses the wafers 30 does not need to be removed in order to program and re-program the active device 100. Because the active device 100 and the programmable memory component 102 are disposed on the wafer 30, the active device 100 may be programmed and reprogrammed through an external programmer that contacts the programming contact pad(s) 104 and sends programming instructions or settings to the programmable memory component 102 through the memory-connecting trace(s) 106. The programming instructions or settings are then stored in the programmable memory component 102 and operating instructions based on the stored instructions may be conveyed to the active device 100 through the active device-bridging trace(s) 108.

As shown in FIGS. 3 and 4, the active device 100 and the programmable memory component 102 may be disposed on the front side 62 of the wafer 30. Alternatively, the active device 100 and the programmable memory component 102 may be disposed on the back side of the wafer 30. Also, alternatively, the active device 100 may be on one of the front side 62 or the back side of the wafer 30, while the programmable memory component 102 is on the other side of the wafer 30. In such a configuration, the active device 100 and the programmable memory component 102 may connect to one another through one or more vias or through-holes and/or traces. In at least one other embodiment, each side of the wafer 30 may include an active device 100 and a programmable memory component 102. Also, alternatively, one or both sides of the wafer 30 may include multiple active devices 100 in communication with one or more programmable memories 102.

Figure 5:
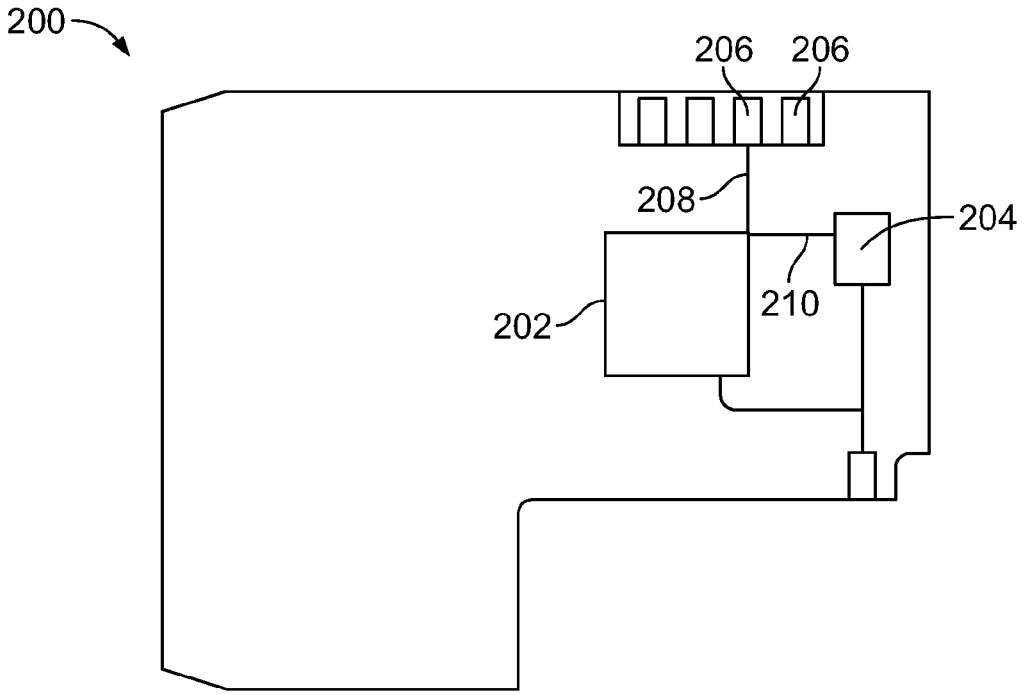
FIG. 5 illustrates a lateral view of a wafer, according to an embodiment of the present disclosure.

FIG. 5 illustrates a lateral view of a wafer 200, according to an embodiment of the present disclosure. For the sake of clarity, various components of the wafer 30 are not shown in FIG. 5. The wafer 200 is similar to the wafer 30, and may include an active device 202 and a programmable memory 204, such as an EEPROM, as described above. One or more programming contact pad(s) 206 connect to the active device 202 through a programming trace 208. The active device 202, in turn, connects to the programmable memory 204 through a connecting trace 210. Thus, programming instructions may be sent to the programmable memory 204 through the programming trace 208. The programming instructions may then pass through the active device 202 and to the programmable memory 204 through the connecting trace 210. Once the programming instructions are stored in the programmable memory 204, the external programmer may be removed from the programming contact pads 206, and the programmable memory 204 may configure the active device 202 based on the stored programming instructions or settings through the connecting trace 210.

Figure 6:
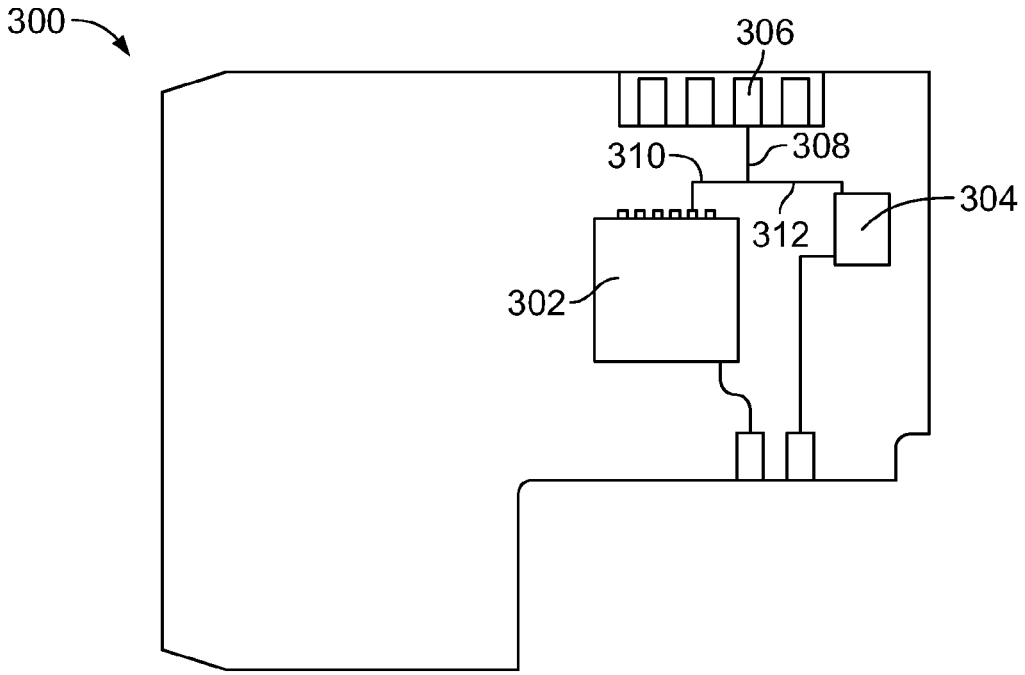
FIG. 6 illustrates a lateral view of a wafer, according to an embodiment of the present disclosure.

FIG. 6 illustrates a lateral view of a wafer 300, according to an embodiment of the present disclosure. For the sake of clarity, various components of the wafer 30 are not shown in FIG. 6. The wafer 300 is similar to the wafer 30, and may include an active device 302 and a programmable memory 304. One or more programming contact pad(s) 306 connect to a programming trace 308 having a first branch 310 that connects to the active device 302 and a second branch 312 that connects to the programmable memory 304. An external programmer may send programming instructions from the programming contact pad(s) 306 to the programmable memory 304 through the second branch 312. The programmable memory 304 may then configure the active device 302 with the stored programming instructions by communicating through the second branch 312 and the first branch 310.

Figure 7:
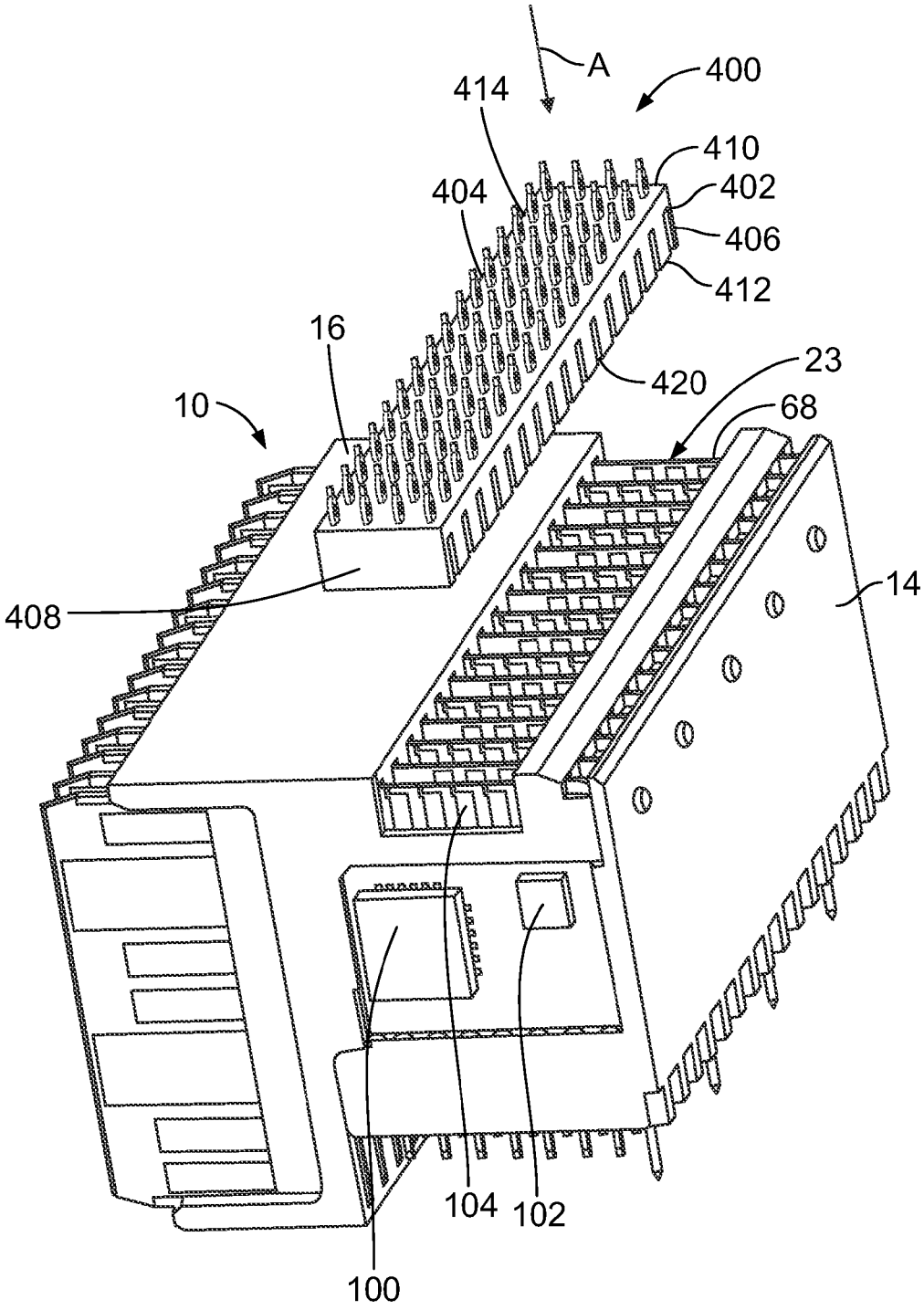
FIG. 7 illustrates a perspective view of an external programmer aligned with an open programmer-receiving channel of a cover of a connector assembly, according to an embodiment of the present disclosure.

FIG. 7 illustrates a perspective view of an external programmer 400 aligned with the open programmer-receiving channel 23 of the cover 16 of the connector assembly 10, according to an embodiment of the present disclosure. The external programmer 400 and the connector assembly 10 may form a configurable connector system. As shown, the open programmer-receiving channel 23 exposes programming contact pads 104 that are proximate to the top edges 68 of each wafer 30. The open programmer-receiving channel 23 may generally be sized and shaped to allow at least a mating interface of the external programmer 400 to fit therein.

The external programmer 400 includes a main body 402 having front and back walls 404 and 406, respectively, integrally connected to lateral walls 408 and top and bottom walls 410 and 412, respectively. A plurality of pins 414 extend upwardly from the top wall 410 and are configured to connect to a printed circuit board (not shown), for example. As one example, the printed circuit board may be part of the external programmer 400, while the main body 402 is the portion of the external programmer 400 that interfaces with the wafer 30. That is, the main body 402 may be the mating interface of the external programmer 400.

Wafer-engaging slots 420 are formed through the front, bottom, and rear walls 404, 412, and 406, respectively, of the main body 402. The wafer-engaging slots 420 are configured to fit over the exposed top edges 68 of one or more of the wafers 30 so that contacts within the main body 402 that define portions of the wafer-engaging slots 420 directly contact the programming contact pads 104 of the wafers 30.

As shown, the number of wafer-engaging slots 420 may equal the number of wafers 30 within the connector assembly 10. Alternatively, the number of wafer-engaging slots 420 may be more or less than the number of wafers 30 within the connector assembly 10. For example, the external programmer 400 may include a single wafer-engaging slot 420 that may be individually positioned on each wafer 30 within the connector assembly 10.

In order to send programming instructions to the programmable memory component 102 on each wafer 30, the external programmer 400 is aligned with the open programmer-receiving channel 23 so that the wafer-engaging slots 420 are aligned over the top edges 68 of the wafers 30 that are to be engaged. The external programmer 400 is then moved into the open programmer-receiving channel 23 in the direction of arrow A so that the wafer-engaging slots 412 fit over the top edges 68 of the wafers 30, and the contacts within the main body 402 contact the programming contact pads 104 of the wafers 30. The contact between the contacts within the external programmer 400 and the programming contact pads 104 allows programming instructions or settings to be sent from the external programmer 400 to the programmable memory component 102 of each wafer 30, as described above. Once the programming instructions or settings have been stored in the programmable memory component 102, the external programmer 400 may then be removed from the open programmer-receiving channel 23.

Figure 8:
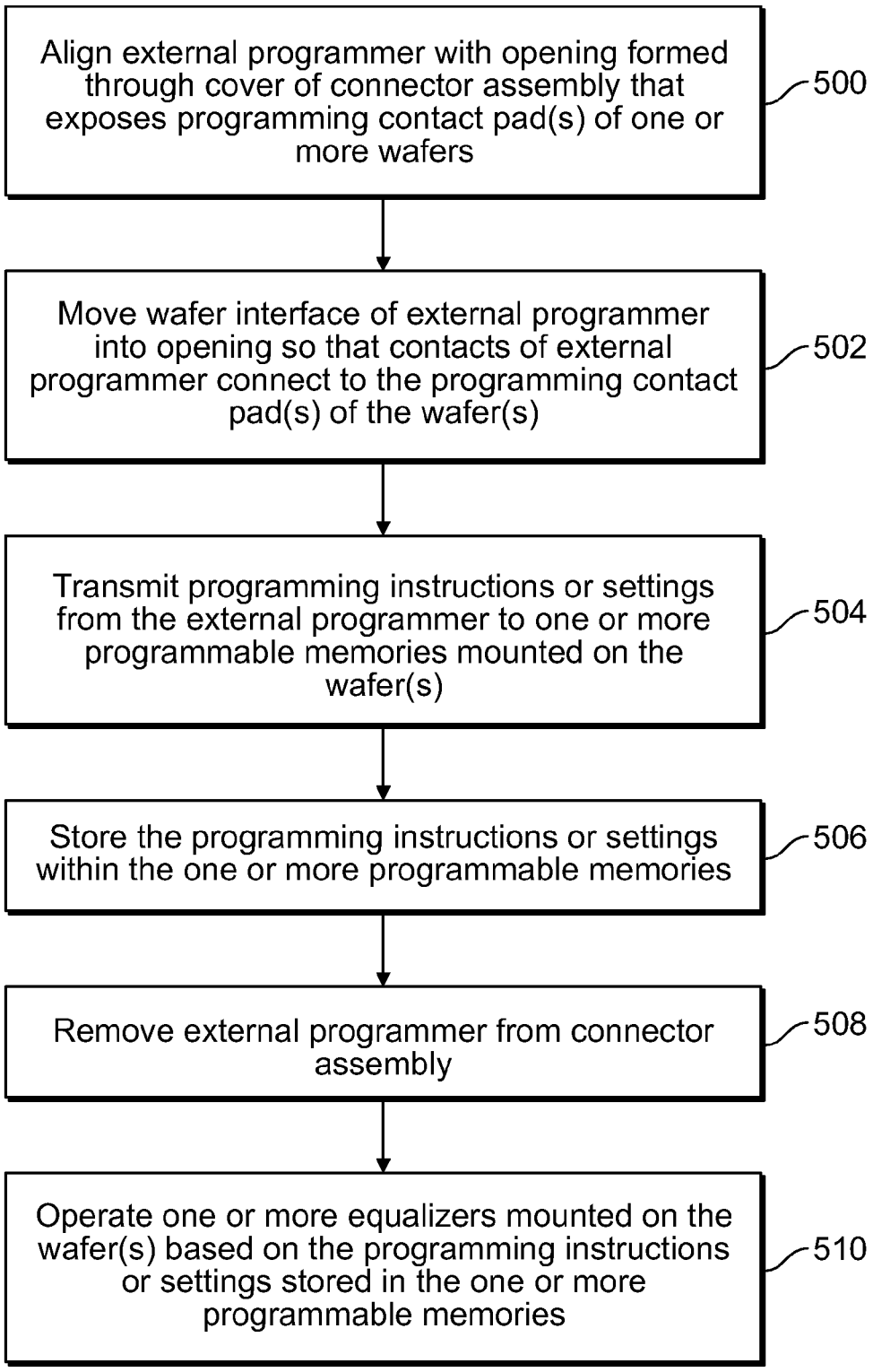
FIG. 8 illustrates a flow chart of a method of configuring an active device mounted on a wafer of a connector assembly, according to an embodiment of the present disclosure.

FIG. 8 illustrates a flow chart of a method of configuring an active device mounted on a wafer of a connector assembly, according to an embodiment of the present disclosure. At 500, an external programmer is aligned with one or more openings formed through a cover of a connector assembly that exposes one or more programming contact pads of one or more wafers. Then, at 502, a wafer interface of the external programmer is moved into the opening so that contacts of the external programmer connect to the programming contact pad(s) of the wafer(s). At 504, programming instructions or settings are transmitted from the external programmer to one or more programmable memories mounted on the wafer(s). At 506, the programming instructions or settings are stored within the one or more programmable memories. After the programming instructions or settings are stored within the one or more programmable memories, the external programmer may be removed from the connector assembly at 508. Then, at 510, one or more active devices mounted on the wafer(s) may be operated based on the programming instructions or settings stored in the one or more programmable memories.

Thus, embodiments of the present disclosure provide a connector assembly that may house one or more wafers, each of which may include an active device and a programmable memory, such as an EEPROM. The programmable memory may receive and store programming instructions from an external programmer, and the programmable memory may then program, adapt, or otherwise configure the active device based on the programming instructions. The active device may be programmed, adapted, or otherwise configured based on system specifications, applications, usage, and/or the like. The programmable memory stores the programming instructions or settings for the active device.

While various spatial terms, such as upper, bottom, lower, mid, lateral, horizontal, vertical, and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the disclosure without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112(f), unless and until such claim limitations expressly use the phrase "means for" followed by a statement of function void of further structure.

What is claimed is:

1. A configurable connector system, comprising:

a connector assembly including a housing; and at least one wafer retained within the housing, wherein the at least one wafer comprises at least one active device in communication with at least one programmable memory component, and wherein the at least one active device is configured to operate based on programming instructions or settings stored within the at least one programmable memory component.

2. The configurable connector system of claim 1, wherein the housing of the connector assembly comprises an open programmer-receiving channel configured to receive at least a portion of an external programmer that is configured to send the programming instructions or settings to the at least one programmable memory component.

3. The configurable connector system of claim 1, further comprising an external programmer having a mating interface configured to removably mate with a portion of the at least one wafer, wherein the external programmer is configured to send the programming instructions or settings to the at least one programmable memory component.

4. The configurable connector system of claim 3, wherein the mating interface comprises a main body having one or more wafer-engaging slots configured to mate with the portion of the at least one wafer.

5. The configurable connector system of claim 1, wherein the at least one wafer further comprises one or more programming contact pads connected to the at least one programmable memory component through at least one first trace, wherein the at least one programmable memory component receives the programming instructions from the one or more programming contact pads through the at least one trace.

6. The configurable connector system of claim 5, wherein the at least one wafer further comprises at least one second trace that connects the at least one active device with the at least one programmable memory component, wherein the at least one programmable memory component communicates with the at least one active device through the at least one second trace.

7. The configurable connector system of claim 1, wherein the at least one wafer further comprises at least one power contact pad connected to one or both of the at least active device and the at least programmable memory component through at least one power trace.

8. The configurable connector system of claim 1, wherein the at least one programmable memory component comprises an electrically erasable programmable read only memory (EEPROM).

9. A wafer configured to be retained within a housing of a connector assembly, the wafer comprising:

at least one active device configured to condition signals conveyed between at least one first signal contact pad and at least one second signal contact pad; and at least one programmable memory component in communication with the at least one active device, wherein the at least one active device is configured to operate based on programming instructions or settings stored within the at least one programmable memory component.

10. The wafer of claim 9, wherein the at least one programmable memory component is configured to receive the programming instructions or settings from an external programmer.

11. The wafer of claim 9, further comprising one or more programming contact pads connected to the at least one programmable memory component through at least one first trace, wherein the at least one programmable memory component receives the programming instructions from the one or more programming contact pads through the at least one trace.

12. The wafer of claim 11, further comprising at least one second trace that connects the at least one active device with the at least one programmable memory component, wherein the at least one programmable memory component communicates with the at least one active device through the at least one second trace.

13. The wafer of claim 11, further comprising at least one power contact pad connected to one or both of the at least active device and the at least programmable memory component through at least one power trace.

14. The wafer of claim 11, wherein the at least one programmable memory component comprises an electrically erasable programmable read only memory (EEPROM).

15. A method of configuring a connector assembly including a housing that retains at least one wafer having at least one active device and at least one programmable memory component mounted on the at least one wafer, the method comprising:

aligning an external programmer with an opening formed in the housing, wherein the opening exposes one or more programming contact pads of the at least one wafer;

moving a wafer interface of the external programmer into the opening so that contacts of the external programmer connect to the one or more programming contact pads of the at least one wafer;

transmitting programming instructions or settings from the external programmer to the at least one programmable memory component of the at least one wafer;

storing the programming instructions or settings within the at least one wafer; and operating the at least one active device of the at least one wafer based on the programming instructions or settings stored in the at least one programmable memory component.

16. The method of claim 15, further comprising removing the external programmer from the opening formed in the housing after the storing the programming instructions or settings with the at least one wafer.

17. The method of claim 15, wherein the external programmer comprises a main body having one or more wafer-engaging slots configured to mate with the one or more programming contact pads of the at least one wafer.

18. The method of claim 15, wherein the transmitting comprises transmitting the programming instructions or settings from the one or more programming contact pads to the at least one programmable memory component through at least one trace.

19. The method of claim 18, wherein the operating comprises communicating operating instructions from the at least one programmable memory component to the at least one active device over a at least one second trace that connects the at least one active device with the at least one programmable memory component, wherein the operating instructions are based on the programming instructions or settings stored in the at least one programmable memory component.

20. The method of claim 15, wherein the at least one programmable memory component comprises an electrically erasable programmable read only memory (EEPROM).

* * * * *